US006419127B1

(12) United States Patent
Fershtut

(10) Patent No.: US 6,419,127 B1
(45) Date of Patent: Jul. 16, 2002

(54) APPARATUS FOR RAISING CONCRETE MEMBERS

(76) Inventor: Steven Fershtut, 2294 E. 1200 North, Layton, UT (US) 84040

( * ) Notice: Subject to any disclaimer, the term of this patent is extended or adjusted under 35 U.S.C. 154(b) by 0 days.

(21) Appl. No.: 09/578,999

(22) Filed: May 25, 2000

Related U.S. Application Data

(63) Continuation-in-part of application No. 09/399,074, filed on Sep. 18, 1999, now Pat. No. 6,068,425.

(51) Int. Cl.[7] ..... B67D 5/00

(52) U.S. Cl. ..... 222/334; 222/319; 222/328; 404/78

(58) Field of Search ..... 222/319, 328, 222/334; 404/78

(56) References Cited

U.S. PATENT DOCUMENTS 2,388,662 A * 11/1945 Anderson et al. ..... 222/334
2,549,851 A * 4/1951 Pope ..... 222/334
2,667,841 A * 2/1954 Meader ..... 222/334
3,994,627 A * 11/1976 Calzolari ..... 417/317
4,022,349 A * 5/1977 McMullan et al. ..... 222/334
5,127,806 A * 7/1992 Benckert ..... 417/279
5,717,131 A * 2/1998 Sunde et al. ..... 73/64.41

* cited by examiner

*Primary Examiner*—J. Casimer Jacyna

(57) ABSTRACT

An apparatus for raising concrete members and maintaining the members in a raised position. The apparatus may be utilized for raising or leveling flat slabs such as sidewalk sections, driveways and patios or for raising sunken sections of curbs and gutters, and the apparatus includes a portable mud pump and mixing tank to provide grout or mud under the raised members for maintaining same in the raised position. A method for raising the members is carried out by attaching the sunken member to an apparatus including one or more lifting jacks, raising the member by the jacks, and at least partially filling the cavity under the member with a grout or mud. The portable mud pump, which includes a limit switch controlled double-acting air driven piston, is connected to a mud or grout mixing tank via a check valve and withdraws mud from the tank during an intake stroke and forces the mud, during a power or output stroke, into a cavity under a raised concrete member. The mixing tank includes power driven members which mix a mud mixture with water, and includes a controlled ambulator assembly which moves about the tank to fully mix the water with the mud mixture.

8 Claims, 9 Drawing Sheets

APPARATUS FOR RAISING CONCRETE MEMBERS

RELATED APPLICATION

This application is a continuation-in-part of U.S. application Ser. No. 09/399,074 filed Sep. 18, 1999, now U.S. Pat. No. 6,068,425 issued May 30, 2000.

BACKGROUND OF THE INVENTION

The present invention relates to concrete raising, more particularly to an apparatus for raising concrete members and maintaining same in the new position by the use of a mud or grout, and more particularly to a portable mud pump and mixing tank for introducing the mud or grout into a cavity under the raised concrete member.

Generally when concrete or cement members such as flat slabs, sidewalk sections, driveways, patios, steps, and curb and gutter sections sink due to a settling of soil thereunder, etc., the sections of concrete are removed and new concrete poured, which is time consuming, costly, and additionally requires the disposal of the removed concrete sections.

The method described and claimed in above referenced application Ser. No. 09/399,074 provides a solution to the problem of sunken concrete members and involves raising the members whereby such need not be removed and replaced. In the case of sunken concrete members, the member is lifted to its original position, or slightly higher, and a mud or grout is pumped into the cavity beneath the raised concrete member which functions to retain the member in its raised position. The mud pump produces sufficient pressure that in some instances the pumped mud will raise the concrete member.

Mud or slurry pumps are well known, as exemplified by U.S. Pat. No. 4,718,826 issued Jan. 12, 1988, U.S. Pat. No. 3,326,135 issued Jun. 20, 1967, U.S. Pat. No. 3,507,347 issued Apr. 21, 1970, and U.S. Pat. No. 4,500,267 issued Feb. 19, 1985. These prior mud pumps are either large units (not readily portable) or are small, manually operated, low volume units. The mud pump and mixing tank of the present invention are readily portable, small enough to fit in a corner of a pickup truck, deliver a sufficient pressure and flow rate of mud, and are easily cleaned and maintained. The portable mud pump of this invention basically consists of an air cylinder, pump body and reversing valve assembly. The mixing tank of this invention includes mixing impellers, stirring rods, and ambulator paddles which mix water and mud mixture to form a mud and prevent it from clumping during mixing and distribution to the pump. Utilizing the method of Ser. No. 09/339,074 an apparatus (pump and mixing tank) of the present invention, concrete or cement members can be repositioned to their original position in less time and at less cost than by removal and replacement.

SUMMARY OF THE INVENTION

It is an object of the present invention to provide an apparatus for use in repositioning concrete members to their original position.

A further object of the invention is to provide a mud pump and mixing tank utilized for raising sunken concrete members, which includes providing a mud or grout thereunder for maintaining the member in its raised position.

Another object of the invention is to provide a portable mud pump and mixing tank which is of small size yet delivers sufficient pressure and flow rate to effectively fill cavities under raised concrete members, and is easily cleaned and maintained.

Another object of the invention is to provide a small, portable grout or mud pump basically consisting of an air cylinder and connected pump body having a double acting piston therein, and a reversing valve assembly connected to a mud or grout supply tank via a check valve.

Another object of the invention is to provide a grout or mud mixing tank for supplying a portable pump and includes stir rods, mixing impellers and ambulator paddles mounted on a single drive shaft within a housing.

Other objects and advantages of the present invention will become apparent from the following description and accompanying drawings. The present invention basically involves a mud pump and mixing tank for use in repositioning of concrete or a cement member to its original position. The apparatus of the present invention may be utilized in the return of the member to its original location and to fill the cavity thereunder with a mud or grout which maintains the member in its original position. The portable mud pump and mixing tank are small and fit very easily in a corner of a pickup truck bed, deliver a sufficient pressure and flow rate of consistently mixed mud to enable filling of cavities under concrete members, and are easily cleaned and maintained. The mud pump basically comprises an air cylinder (with a reciprocating piston), pump body, and a reversing valve assembly. The reciprocating piston is pneumatically driven and mud is drawn from the mixing tank into the pump body on the intake stroke, and that same mud is pumped or forced from the pump body by the piston or ram on the output stroke through a hose into the cavity or point of use. At the end of each stroke, a limit switch actuates an air valve assembly which reverses the air flow direction and thus the direction of movement of the reciprocating piston within the pump body which provides a substantial flow of mud to the point of use. The mixing tank basically comprises a housing with openings for the entry of water and mud mixtures, a discharge nozzle, a drive shaft on which are mounted stir rods, large and small impellers, an ambulator paddle assembly, and a mix/feed control.

DETAILED DESCRIPTION OF THE INVENTION

The present invention is directed to an apparatus comprising a mud pump and mixing tank used for raising concrete slabs or curb and gutter sections. Sunken concrete members can be raised to their original position and retained in the raised position by mud or grout pumped thereunder, and the concrete member repositioned to its original location. The apparatus utilized, in addition to the mud pump and mixing tank for carrying out the concrete repositioning, includes conventional concrete drills, inserts, connectors, chains and lifting devices. The portable mud pump of this invention basically consists of an air cylinder and pump body with a reciprocating piston therein and a reversing valve assembly, and the mixing tank of the invention includes a single drive rod on which stir rods, impellers and ambulator paddles are mounted, along with a mix/feed control.

The mud pump and mixing tank are small in size so as to be carried in a corner of a pickup truck bed, and which can deliver a sufficient pressure and flow rate to quickly fill cavities formed under the raised concrete members. In addition, the portable mud pump and tank are easily cleaned and maintained. The air cylinder of the mud pump includes a reciprocating piston connected to the piston of the pump body and which is reciprocated by directing a pneumatic fluid, such as air or gas, to opposite sides of the air cylinder piston, which causes the pump body piston to draw mud or grout from the mixing tank during the intake stroke and forcing or pumping that mud through a hose or pipe during the output or power stroke, whereby the mud is forced through the hose or pipe to a point of use, such as a cavity under a raised concrete member. At the end of the pump stroke, a limit switch actuates the valve assembly which reverses the air fluid causing the pump piston to return, thereby ingesting more mud (intake stroke) from the mixing tank via a check valve. At the end of the intake stroke, a limit switch reverses the valve assembly and the cycle starts over again.

Figure 1A:
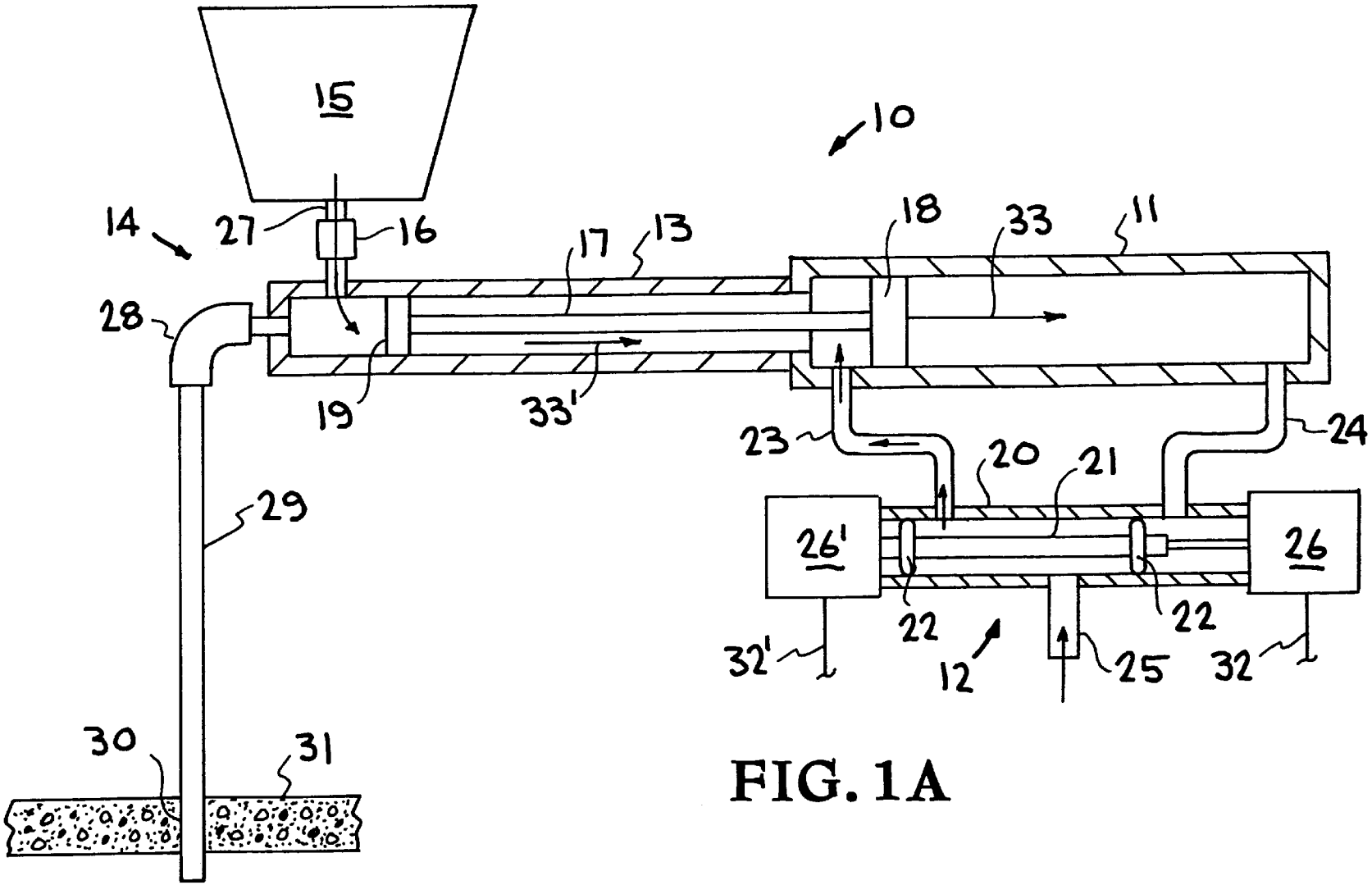
FIGS. 1A and 1B schematically illustrate the intake stroke and the power stroke of an embodiment of a portable mud pump of the present invention.
Figure 1B:
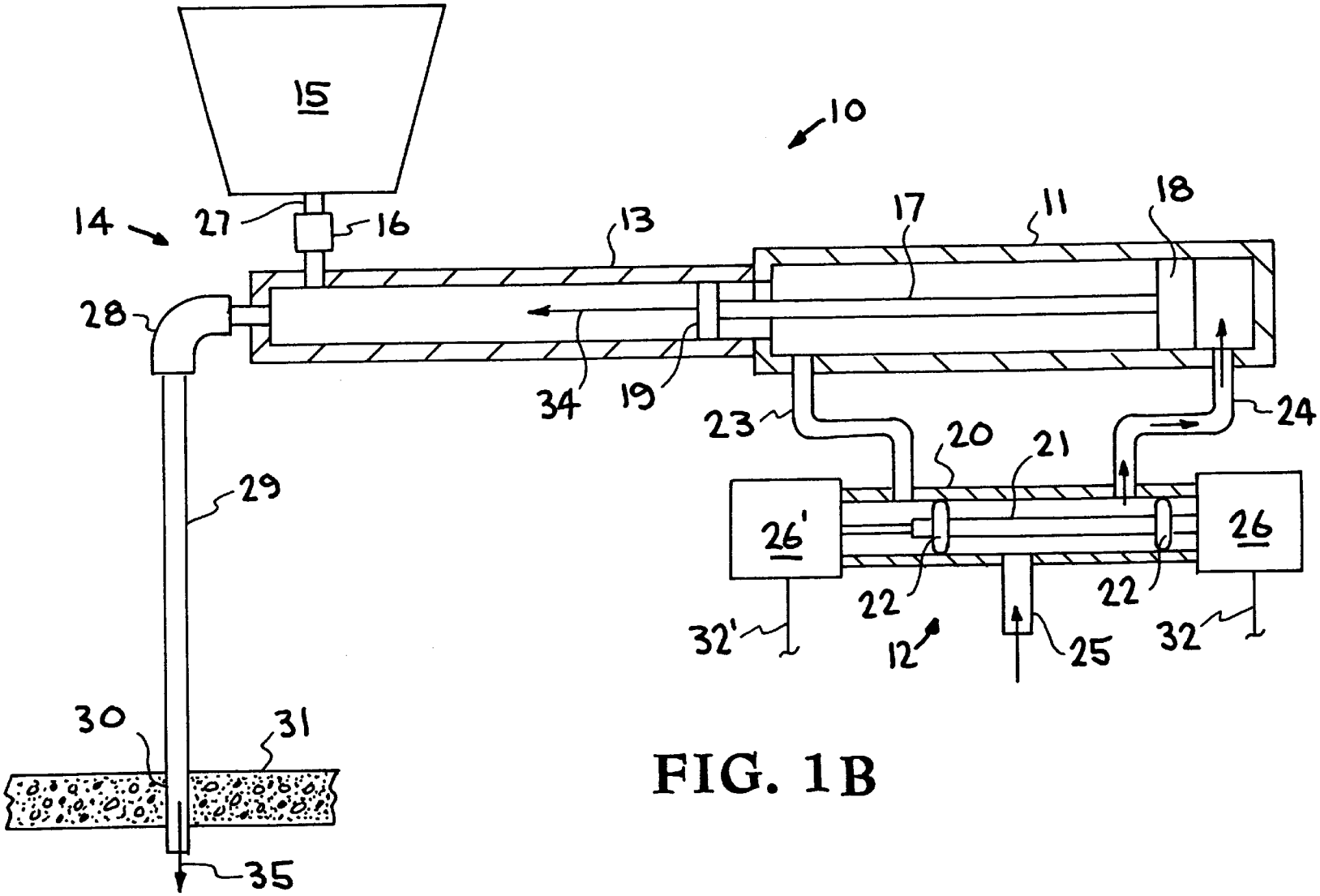

Referring now to the drawings, FIGS. 1A and 1B illustrate the intake and pump (output) strokes of an embodiment of the portable mud or grout pump assembly, generally indicated at 10, which comprises an air cylinder 11, a reversing valve assembly 12 for the air cylinder 11, a pump body 13 connected at one end to the air cylinder 11 and having a discharge line (generally indicated at 14), and a mud or grout mixing tank 15 connected to the pump body 13 via a check valve 16, and described in detail hereinafter relative to FIGS. 10–15. The air cylinder 11 and pump body 13 are constructed to include a double–headed piston assembly composed of a rod 17 and piston heads 18 and 19, with piston head 18 being located in air cylinder 11 and of a larger diameter than piston head 19 located in pump body 13. The reversing valve assembly 12 includes a cylinder 20 containing a shaft or rod 21 having spaced members 22, such as O-rings positioned thereon, with each end of cylinder 20 being connected by lines 23 and 24 to opposite ends of air cylinder 11, an air supply line 25 connected to cylinder 20, and control mechanisms 26 and 26' for shaft 21 located at one end of cylinder 20. Pump body 13 is connected to mixing tank 15 via a line 27 in which check valve 16 is mounted. The discharge line 14 of pump body 13 may be of various lengths and may include an elbow 28 and nozzle or coupler 29 which is constructed to extend through an opening or drilled hole 30 in a concrete member 31 to deposit mud or grout from tank 15 to beneath the concrete member 31. The control mechanisms 26 and 26' for reversing valve assembly 12 are illustrated in greater detail in FIG. 4A and include an electric motor connected to a power supply via electrical leads (generally indicated at 32 and 32' in FIGS. 1A and 1B).

Referring to FIG. 1A, at initiation of an "intake stroke", the valve assembly 12 is activated by control mechanisms 26 and 26' to move the shaft 21 to the left allowing air (as indicated by arrows) to flow via supply line 25 cylinder 20 and line 23 into the left end of air cylinder 11 against piston head 18 (an intake stroke side). As the piston head 18 moves to the right (as indicated by arrow 33), it causes the piston head 19 to produce a suction in the left end of pump body 13 which causes the check valve 16 to open and mud or grout from mixing tank 15 to flow (as indicated by arrows) into pump body 13 via line or pipe 27. As piston head 19 is drawn to the right end of pump body 13 (as indicated by arrow 33') by the air pressure applied against piston head 18 in air cylinder 11, the pump body 13 is filled with mud or grout from tank 15. When piston head 18 reaches a point in air cylinder 11, it contacts a limit switch (illustrated and described in FIG. 2) which causes the control mechanisms 26 and 26' to move the rod 21 in cylinder 20 which directs the air flow from supply line 25 through cylinder 20 and line 24 into the right end of air cylinder 11 and against the opposite side (power stroke side) of piston head 18 (as indicated by arrows in FIG. 1B) which initiates the "pump stroke". As the piston head 18 moves to the left, it moves piston head 19 to the left (as indicated by arrow 34) causing the mud or grout in pump body 13 to move toward the left, which closes the check valve 16 and forces the mud through discharge line 14, through opening 30 and under concrete member 31 (as indicated by arrow 35). At the end of the pump stroke, piston head 18 contacts a limit switch (see FIG. 2) which causes the control mechanisms to move shaft 21 to the left whereby another "intake stroke" is initiated (as shown in FIG. 1A) and the intake pump cycle is repeated until the desired amount of mud is deposited at the point of use.

Figure 2:
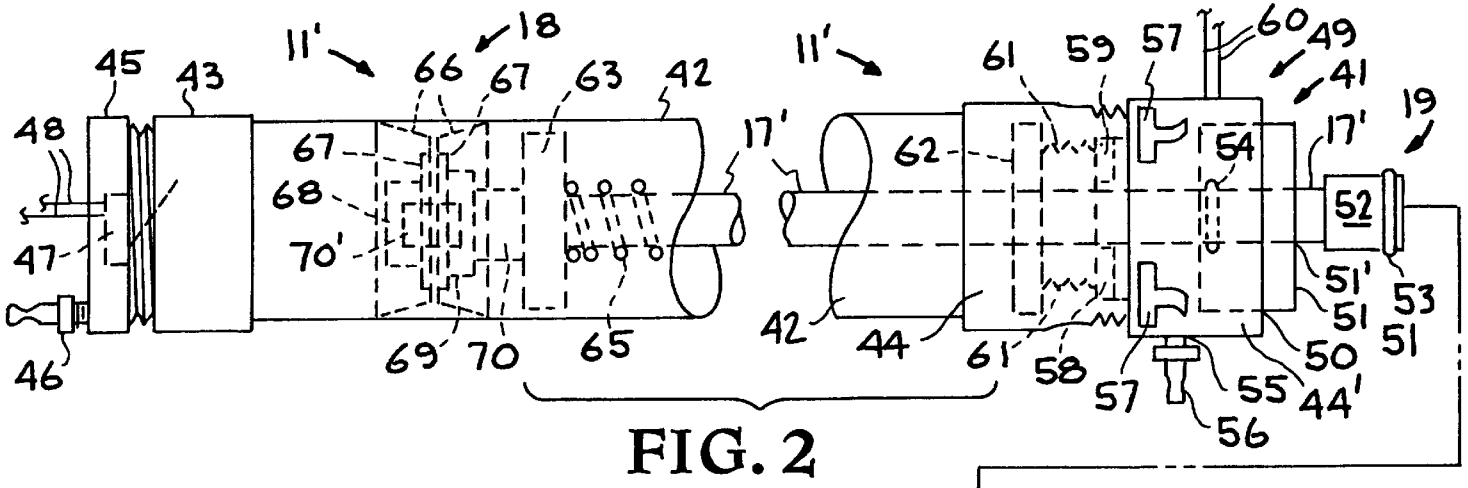
FIG. 2 partially illustrates an enlarged view of an embodiment of an air cylinder of the mud pump of FIGS. 1A and 1B, with internal components illustrated by dash lines.

FIG. 2 illustrates a detailed embodiment of an air cylinder of the portable mud pump of FIGS. 1A–1B (generally indicated at 11'), and which is adapted to be removably connected to a pump body (illustrated in detail in FIG. 3) as indicated by the dash–dot line 40 via a pump body connector assembly (generally indicated at 41 at the right end of air cylinder 11'). The piston head (such as piston head 18 in FIGS. 1A–1B) is illustrated in FIG. 2 as comprising a pair of piston cups with steel backing plates. Air cylinder 11' includes a cylindrical body member 42 connected at the left end to a member 43 and at the right end to a member 44 which is connected to pump body connector assembly 41. Connected to member 43 is an end cap or plate 45 in which is mounted an air connector or tab 46 adapted to be connected, for example, to line 24 of the reversing valve assembly 12 of FIGS. 1A–1B to direct air to air cylinder 11' to produce the power or pump stroke described above with respect to FIG. 1B. Also mounted in end cap 45 is a microswitch 47 having leads 48 connecting to a relay for the control mechanisms 26–26' of FIGS. 1A–1B, as described hereinafter with respect to FIG. 5. Pump Body connector assembly 41 includes a body or adapter or housing 49 defining an opening 50 in which a member 51 having an opening 51' is positioned, with a piston connector rod 17' extending through opening 51', with rod 17' being provided with a piston head 52 (piston 19 of FIGS. 1A–1B) having an O-ring 53 thereon. Rod 17' is also provided with an O-ring 54 located within member 51. Mounted in an opening 55 in housing 49 is an air connector or tab 56 adapted to be connected, for example, to line 23 of reversing valve assembly 12 of FIGS. 1A–1B to direct air to air cylinder 11' to produce the intake stroke described above with respect to FIG. 1A. Attached to the exterior of housing 49 are a plurality of pump body connectors 57 (only two shown). Mounted within members 41 and 44 is a member 44' on which a pair of microswitches 58 and 59 are mounted, with microswitch 59 being a backup, and microswitches 58 and 59 are connected by leads 60 which extend through housing 49 and into member 44 for connection to a relay, as described hereinafter with respect to FIG. 5. Also mounted to member 44' are a pair of return springs 61 which are positioned adjacent a limit actuator 62 located within member 44 and which function as a damper for the piston head in its power stroke and to assist the piston head, such as 18 of FIG. 1A (not shown) in its return or intake stroke.

A limit actuator 63 is pressed on shaft 17' against an adapter 69. Piston 18 of FIG. 1 comprises in this embodiment a pair of piston head cups 66 which are mounted back to back between an adapter 69 and a cap 68, with steel backing plates 67 located on the inside of each piston cup 66. An adapter 70 interconnects shaft 17' and adapter 69, and a connecting shaft 70' attaches cap 68 to adapter 69 through piston cups 66 and backing plates 67, with adapter 70 being threaded into adapter 69.

At the end of the power stroke, limit actuator 63 pushes a spring 65 against limit actuator 62 located in member 44, with spring 65 functioning as a damper to stop the piston 18 (piston cups 66) and to assist the piston 18 in its return or intake stroke when driven by air via intake tab 56.

Figure 3:
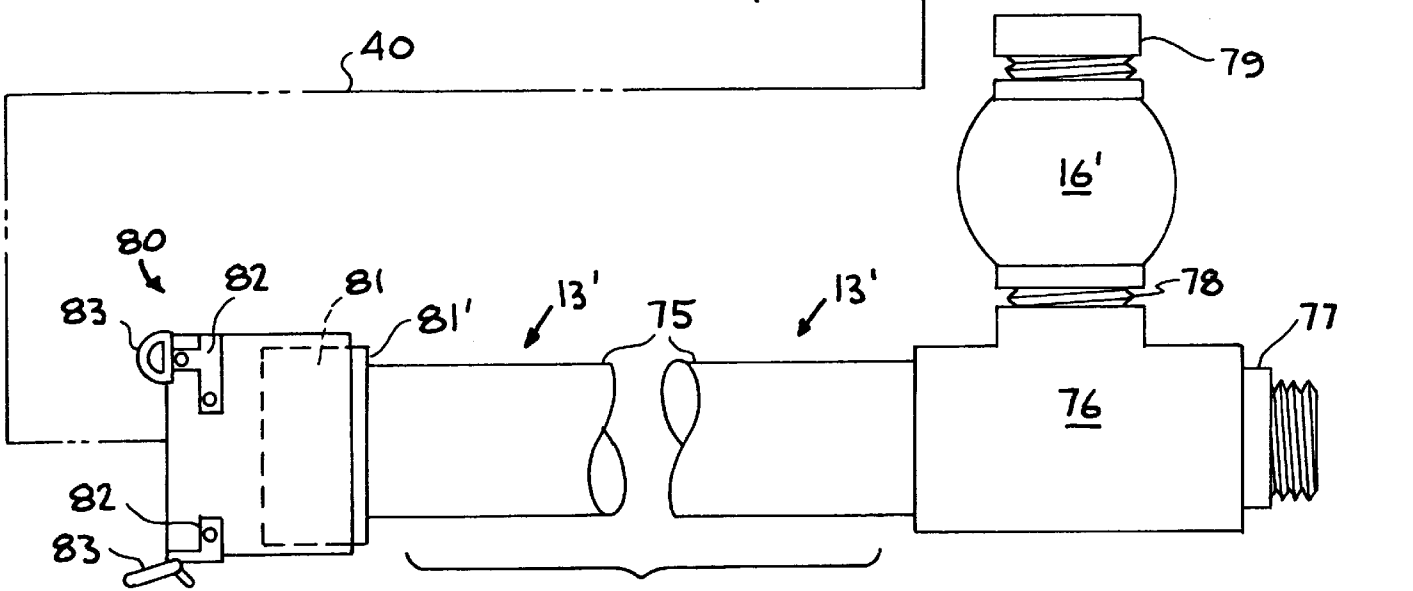
FIG. 3 partially illustrates an embodiment of a pump body of the mud pump of FIGS. 1A and 1B, and is constructed to be attached to the air cylinder of FIG. 2, as indicated by the dash-dot line.

FIG. 3 illustrates an embodiment of a pump body of a portable mud pump of FIGS. 1A–1B and a check valve (indicated at 16') adapted to connect the pump body (indicated at 13') to a mud or grout mixing tank, such as tank 15 in FIGS. 1A–1B. Since check valves are conventionally known, further description of the valve 16' of FIGS. 1A–1B is deemed unnecessary. By way of example, the check valve 16' of FIG. 3 may be of a 2 inch type, which is of sufficient size to permit passage therethrough of the desired amount of mud or grout from a supply tank. As shown in FIG. 3, pump body 13' includes a cylinder 75 within which piston connector rod 17' and piston head 52 of FIG. 2 are located as indicated by the dash-dot line 40. Cylinder 75 is connected at one end to a Tee coupler 76 which is connected to a coupler 77 which may be connected to a discharge hose or assembly (such as shown at 14 in FIGS. 1A–1B) and to check valve 16' by a threaded coupler 78, with the check valve being connected to a threaded coupler 79 for connection to a mud or grout supply. An opposite end of cylinder 75 of pump body 13' is connected to a coupler assembly generally indicated at 80, which is adapted to be coupled (as indicated by the dash-dot line 40) to pump body connector assembly 41 of FIG. 2. Coupler assembly 80 includes a hollow housing or member 81 having a plurality of air cylinder connector members 82 (only two shown) mounted thereon and which include a ring member 83 adapted to contact and retain pump body connectors 57 of FIG. 2. The housing 81 of connector assembly 80 extends over member 51 and abuts housing 49 of pump body connector assembly 41 of FIG. 2 whereby ring members 83 can be attached to connectors 57 of FIG. 2. With the piston 52 (piston 19) positioned in pump body 75 of FIG. 3, the assembly of FIGS. 2 and 3 will function as described above with respect to FIGS. 1A–1B.

Figure 4A:
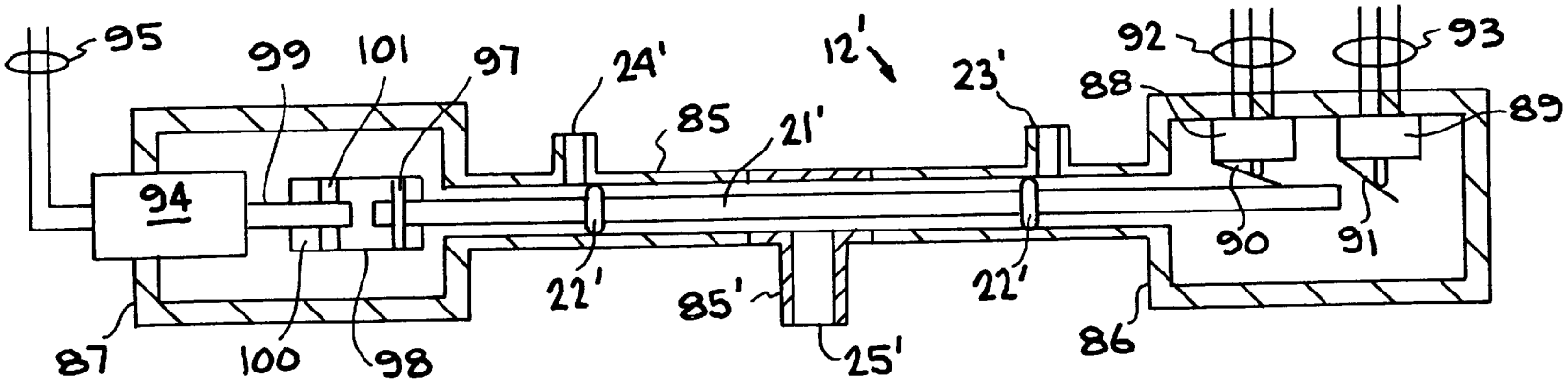
FIGS. 4A and 4B illustrate an embodiment of an air valve assembly of the mud pump of FIGS. 1A and 1B, with FIG. 4B illustrating an enlargement of the internal shaft of FIG. 4A, as indicated by the dash-dot line.
Figure 4B:
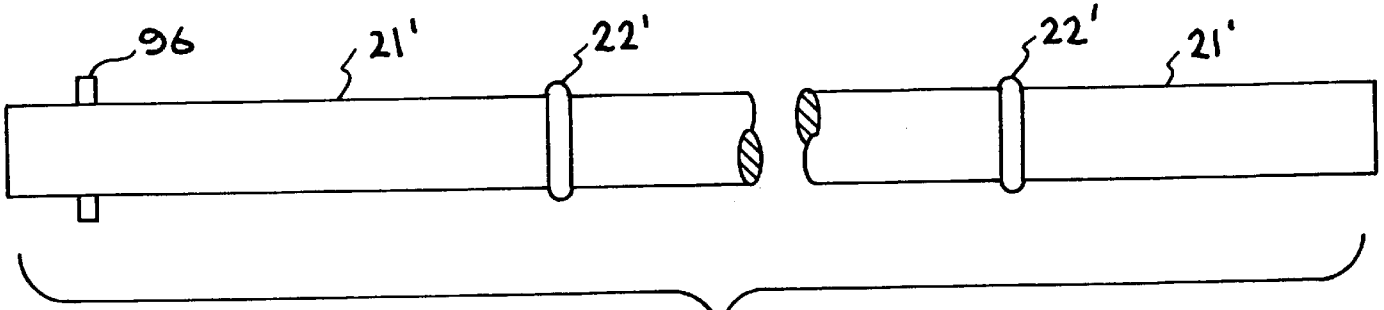

FIGS. 4A and 4B illustrate a detailed embodiment of a reversing valve assembly, such as valve assembly 12 of FIGS. 1A–1B. FIG. 4B is an enlarged view of the valve shaft or rod of FIG. 4A. As shown, the reversing valve assembly embodiment (indicated generally at 12') comprises two cylinders or tube sections 85 connected by a T–member 85' and secured to hollow end housing or body sections 86 and 87, with a valve shaft 21' extending through cylinder sections 85 and into end housing sections 86 and 87, and provided with spaced O-rings 22'. Cylinder sections 85 are provided with connectors 23', 24' and T-member 85' is provided with a connector 25', with connectors 23' and 24' being adapted to be connected to opposite ends of the air cylinder 11, and connector 25' being adapted to be connected to an air supply, similar to lines 23, 24 and 25 of FIGS. 1A–1B. Housing section 86 is provided with a pair of microswitches 88 and 89 having activator member 90 and 91 respectively, which are contacted by movement of valve shaft 21 and are connected by leads 92 and 93 to a relay of the control system of FIG. 5. Within housing section 87 is mounted a reversible (CW or CCW) electric motor 94 having electrical leads 95 connected to a relay of the control system of FIG. 5. Valve shaft 21' is provided at one end with a roll pin 96 via which shaft 21' is connected by a smaller roll pin 97 in a rod/shaft coupling 98 to motor 94 via a threaded rod or actuator shaft 99 and a threaded insert 100 and a spacer 101. In operation, as reversible motor 94 is actuated to rotate in one direction, the threaded rod 99 via threaded insert 100 and roll pins 96 and 97 within coupling 98 cause valve shaft 21' to move in one direction, and rotation of reversible motor 94 in an opposite direction causes valve shaft 21' to move in an opposite direction. Thus, the O-rings 22 on valve shaft 21' are moved along cylinder or tube section 85 so as to connect air input 25' to pump intake connector 23', or to connect air input 25' to pump power connector 24', whereby piston head 18 of FIGS. 1A–1B is driven by air flow in either its intake stroke or power (output) stroke, as described above with respect to FIGS. 1A–1B. The microswitches of the limit actuator 62 are constructed and positioned such that only the push buttons thereof are contacted, thus protecting the switches from excessive force.

Figure 5:
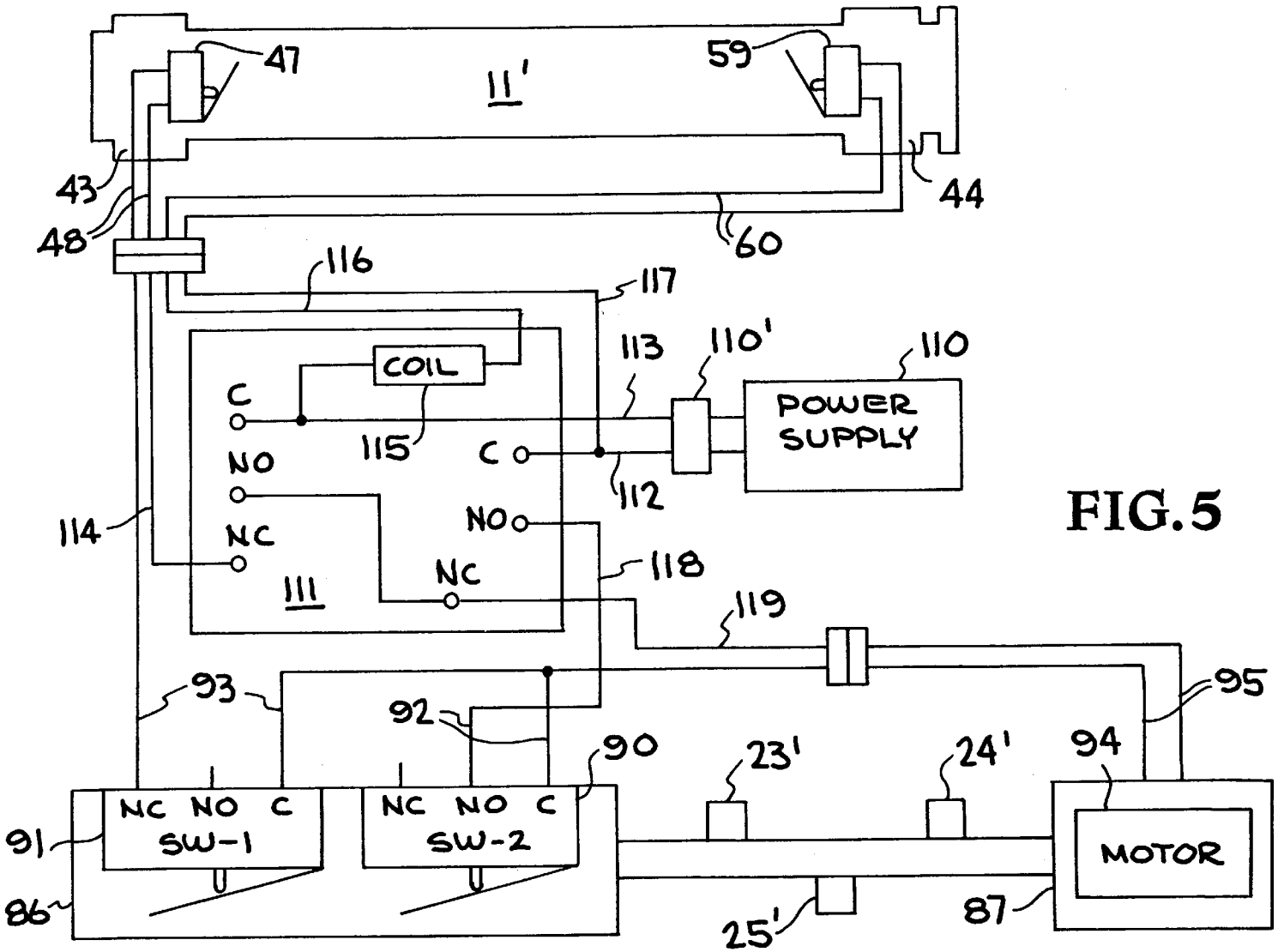
FIG. 5 schematically illustrates a control system for the various components of FIGS. 2, 3 and 4A–4B.

FIG. 5 illustrates schematically an embodiment of a control system for the components of FIGS. 2, 3 and 4A–4B for controlling the portable mud pump of FIGS. 1A–1B. As shown in FIG. 5, a 12 volt dc power supply 110 is electrically connected to a relay 111 via an on/off switch 110' and leads 112 and 113. Leads 48 of microswitch 47 are electrically connected to one of the leads 93 of microswitch 91 and to a lead 114 of relay 111. Leads 60 of microswitch 59 are electrically connected to a coil 115 of relay 111 via a lead 116 and to lead 112 of power supply 110 via a lead 117. Another of leads 93 of microswitch 91 is electrically connected to one of the leads 95 of motor 94. One of the leads 92 of microswitch 90 is connected to lead 93 of microswitch 91 and another of the leads 92 of microswitch 90 is connected to relay 111 via a lead 118. The other lead 95 of motor 94 is connected electrically to relay 111 via a lead 119. While FIG. 4A shows the microswitches 90 and 91 each having three (3) leads 92 and 93 respectively, one of the three leads of each microswitch can be connected to ground as indicated in FIG. 5.

By way of example, the major components of the air cylinder 11' of FIG. 2 may be constructed and sized as follows: Cylinder 42 being of plastic, such as polyvinylchloride (PVC), with an inner diameter of 3 to 4 inches, preferably 3 inches. Member being 44 made of PVC, having an inner diameter of 3 to 4 inches and an outer threaded end diameter of 3 to 4 inches. Housing 49 being made of PVC, with threaded inner diameter of 3 to 4 inches and outer diameter of 3 to 4 inches. Member 43 having an inner diameter of 3 to 4 inches and thread end of 3 to 4 inch diameter. End cap 45 being made of PVC, having an inner threaded diameter of 3 to 4 inches. Piston connector rod 17' may be hollow or solid, made of PVC or aluminum, having an outer diameter of 1 to 1.5 inches and length of 25 to 30 inches. Piston head 52 may be made of PVC or aluminum with an external diameter of 1.50 to 2.00 inches. The member or adapter 51 being made of PVC having an internal diameter of 1.00 to 1.25 inches and an external diameter of 1.25 to 1.50 inches. The piston cups 66 may be made of polyurethane or rubber, with piston head 18 (cups 66) having a diameter of 3 to 4 inches and thickness of 0.040 to 0.100, with piston head 19 being secured to the piston connector rod by roll pin or by threaded connection. Limit actuators 62 and 63 may be made of PVC with inside diameters of 1.30 to 1.80 inch and outside diameter of 2.875 to 3.875 inches, and thickness of 0.50 to 1.00 inches. Cylinder 75 may be made of PVC, having an inner diameter of 2.0 to 3.0 inches and outer diameter of 2.35 to 3.60 inches. Coupler 76 may be made of PVC. Check valve 16' may be of a two inch size. Coupler assembly housing 81 may be made of PVC with an inner diameter of 2.3 to 3.5 inches and outer diameter of 3.5 to 4.8 inches. An adapter 81' connects housing 81 to pump body 75 and may be made of PVC with an inner diameter of 2.30 to 3.50 inches and an outer diameter of 3.25 to 4.50 inches. Cylinder section 85 may be made of PVC with an inner diameter of 1.0 to 1.5 inches, length of 10 to 20 inches, and secured to housing sections 86 and 87 such as by cement or pins. Housing sections 86 and 87 may be made of PVC with an outer diameter of 1.875 to 2.5 inches and length of 3.0 to 5.0 inches. Valve shaft 21' is solid, made of PVC, nylon or lucite, having a diameter of 0.45 to 0.75 inch and length of 12 to 15 inches. O-rings 22 may have an outer diameter of 0.55 to 0.77 inches. Motor 94 may be of a 12 volt direct current or AC reversing type with a horsepower rating of 0.01 to 0.10 being sufficient. The air supply to air line or connector 25 may have a pressure of 10 to 125 psi and produced such as by a small portable air compressor. The roll pin 96 in valve shaft 21' is, for example, 3/16 inch and is centered in the end of the coupling 98. The roll pin 97 is 1/16 inch and is centered at the end of coupling 98. The small diameter roll pin 97 is inside the larger roll pin 96 with a resulting gap of about 1/16 inch which acts to impact the shaft 21' when motor 94 is energized, overcoming static friction of the O-rings 22' against the cylinder or tube section 85. The threaded insert 100 is made of metal, such as aluminum, carbon steel or stainless steel. The spacer 101 is made of nylon, PVC or aluminum. The coupling 98 may be made of aluminum or steel. The mud or grout tank 15 may be of a 5 to 10 gallon size.

Figure 7:
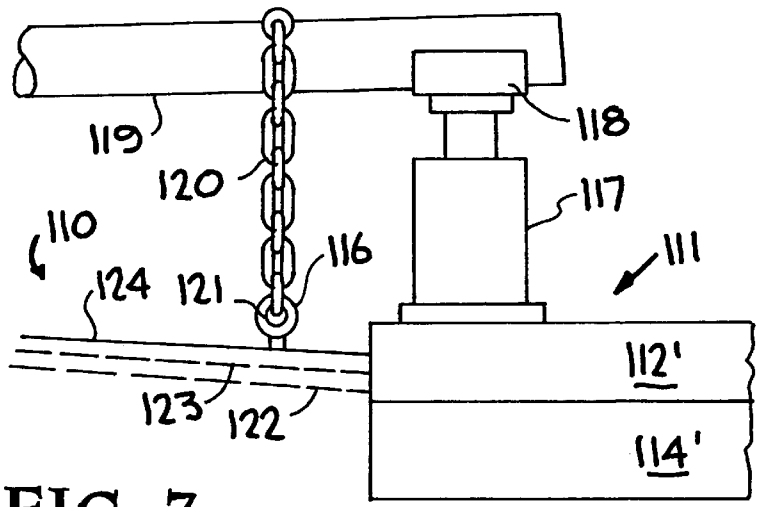
FIG. 7 is a side view of the curb and gutter sections of FIG. 6 and illustrating the lifting apparatus and an operational lifting sequence of raising a concrete curb and gutter section.
Figure 6:
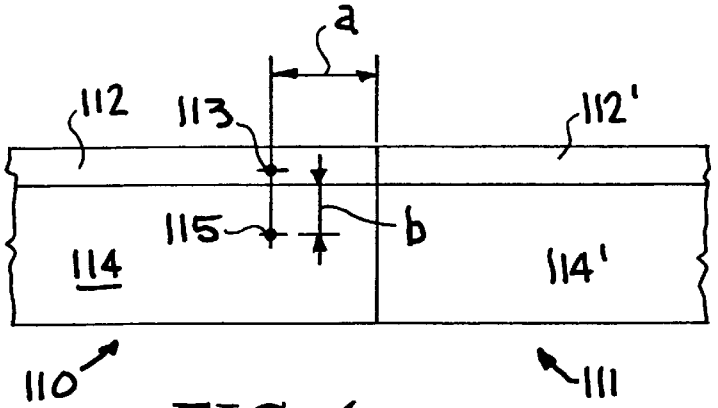
FIG. 6 is a plan or top view of adjoining sections of a concrete curb and gutter with one section sunken, and illustrating drill holes for the lifting apparatus.
Figure 9:
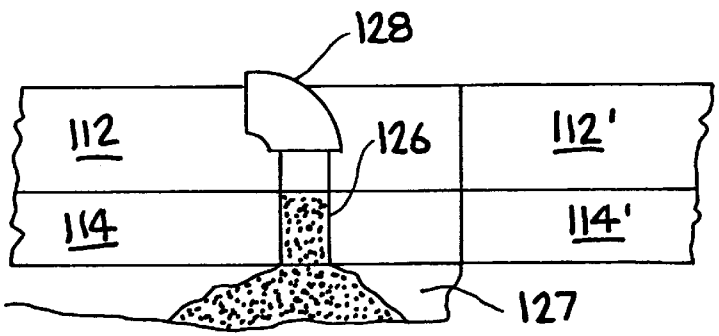
FIG. 9 illustrates a side view of the FIG. 6 curb and gutter section showing the cavity formed by lifting the sunken section being filled with mud or grout from a pump hose end coupler of the portable mud pump and mixing tank of FIGS. 1A–1B and 10–15.
Figure 8:
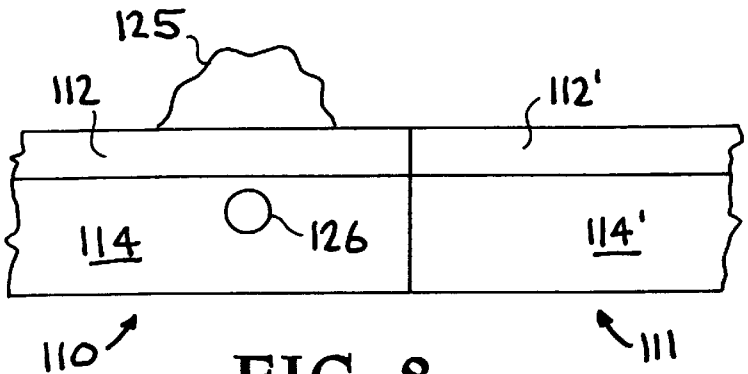
FIG. 8 illustrates a top view of the curb and gutter sections of FIG. 7 with an adjacent hole, or alternate injection hole, for mud or grout insertion below the lifted curb and gutter section.

FIGS. 6–9 illustrate a method of raising a sunken section of curb and gutter,and the method is set forth as follows:

As shown in the top view of FIG. 6 and the side view of FIG. 7, a sunken section 110 is to be raised to the height of an adjacent section 111. As seen in FIGS. 6 and 7, a hole is drilled and a drop–in anchor is set at the center of the top of the curb 112 at a point 113 which is 4 inches (as indicated by arrow a from the end of section 110). A second hole is drilled and an anchor set in the gutter 114 at a point 115 which is 5–6 inches from the curb 112 (as indicated by arrow b). Insert a connector member, such as an eye bolt 116 (only one shown), in each of the anchors and tighten. Place a jack 117 (such as a 6-ton hydraulic jack) on the curb 112' of adjacent section 111 and a similar jack (not shown) on the gutter 114' of adjacent section 111 such that the jacks are opposite the eye bolts 116. Set a pole saddle 118 on each jack 117, and then place the end of an eight foot long 3 inch pole 119 in the saddle 118, as shown in FIG. 7. Position the poles 119 parallel running the length of the curb and gutter section 110 (generally formed in 8 foot long sections). Drape a chain 120 (such as a 5/16 inch metal chain) over each pole 119 and attach each chain to the eye bolt 116 in the curb 112 and gutter 114 using a removable member (such as a 7/16 inch grade eight bolt and nut 121). Be certain that the chain 120 is pulling straight up on the eye bolt 116, and jack up the pole 119 until both chains 120 are taut. Then jack both jacks 117 in tandem until the curb and gutter section 110 starts to move up from its original position (indicated at 122). Keep jacking until the effort increases and there is no observable raising movement of the sunken section 110 (such as indicated as the 1st lift 123). Allow the section 110 to set at the first lift 123 for 30 seconds to one minute so as to relax and push on both adjacent slabs or sections 110 and 111. Release the jacks 117 and allow the section 110 to move down half way from the 1st lift position 123. Reset the jacks 117 and jack back up to the 2nd lift position 124. Allow the section 110 to set for 30 seconds to one minute, release the jacks and lower the section 110 to half way, reset the jacks, and continue the above sequence of operations. Each iteration yields more motion or upward movement of the section 110. Alternatively, after section 110 is up 1.25 inch, insert injection pump hose and allow the pumped mud to assist in raising. When the section 110 has been raised to the level of the adjacent section 111, dig out the grass and dirt next to the curb 112 (as indicated at 125 in FIG. 8) about six inches from the end of section 110. In cases where the curb 112 is adjacent a sidewalk, for example, an alternate injection hole 126 must be drilled in the gutter 114, as shown in FIG. 8. If using the hole 125, place a section of hose in the hole 125 so as to extend into the cavity under section 110 to about one third the way across the gutter 114. Attach the hose to the discharge line 14 of the portable mud pump 10 of FIGS. 1A–1B, for example, and pump mud or grout into the cavity under the section 110 until section 110 is held up without the jacks 117. Remove the hose and replace the dirt and grass so as to fill hole 125. Remove the jacks, poles and eye bolts. If desired, the anchors in the curb 112 and gutter 114 may be filled with a filler type cement. FIG. 9 illustrates filling a cavity 127 using the alternate injection hole 126 of FIG. 8, wherein a riser 128 for the portable mud pump discharge line 14 is inserted into hole 126 and the cavity is filled with mud, as above described. The mud or grout may, for example, be composed of a mixture of sand, cement and lime, using 80% sand, 10% cement, and 10% lime, with an initial set up time of 3 to 6 hours and curing time of 24 to 36 hours. Also, a mixture of 80% sand, 15% clay, and 5% lime has been used satisfactorily. The mud mixture is generally made and placed in the mixing tank of the mud pump at the time of use to prevent setting up of the mud in the tank. Also, after each use if there is extended time until the next use, at least the mixing tank should be emptied.

FIGS. 10–15 illustrate an embodiment of a mixing/feed tank, such as the tank shown at 15 in FIGS. 1A–1B, made in accordance with the present invention. Basically, the mixing/feed tank embodiment is driven by an electric motor (not shown) belted to a sheave or pulley which transmits power through the U-joint to the main shaft. Impellers mix water and a mud mixture into a mud or grout, and stirring rods stir the entry mud mixture from the top to prevent clumping. With a cowl in the "down" position, ambulator paddles provide a forward motion to the main shaft (since only the uncowled paddles cause any residual force on the shaft) moving it around the circumference of the tank, mixing the water and mud mixture. The cowl is placed in the "up" position at first in order that the water swirl around the tank and mix with the mud mixture prior to the ambulator paddles being engaged.

The mixing tank includes a mix/feed control and in its "up" position allows the ambulator paddles to move the shaft around the tank, and in the "down" position keeps the shaft in place over the discharge nozzle. The tank is supplied with water via a valve and spray nozzle arrangement and supplied with the mud mixture as follows: Three gallons of water are sprayed into the tank via a nozzle, and a dry mud or grout mixture is then added and mixed via a vortex caused by the drive assembly. As the mixture thickens, the cowl is pushed down and the drive shaft then moves around the interior of the tank via the ambulator paddles, and the mix thickness is adjusted by adding water and/or dry mix. The tank is set in a frame with wheels for transport and attachment to the portable pump.

Referring now to the drawings, the embodiment of the mixing tank illustrated in FIGS. 10–15 (generally indicated at 15') comprises a tank, container or housing 130 having openings 131, 132, 133, 134, 135 and 136. In opening 131, a discharge nozzle or coupling 137 is mounted and is adapted to be connected to check valve 16 of mud pump 10 (as shown in FIGS. 1A–1B), a pivot support member (generally indicated at 138) being mounted in opening 132, a water injection assembly (generally indicated at 139) being mounted in opening 133, a mud mixture is inserted into tank 130 via opening 134, bearings 140 of a drive assembly (generally indicated at 141) are mounted in opening 135, and a mix/feed control handle 142 of an assembly (generally indicated at 143) extends through opening 136. Tank 130 may be mounted in a cart 144 for portable application, with the cart having wheels 145 (only two shown), and tank 130 being provided with a lift/pull handle 146, with cart 144 having an opening 147 through which discharge nozzle 137 extends. If desired, the top of tank 130 may be open with a bracket extending thereacross for supporting the drive assembly 141 and mix/feed control handle 142.

Water injection assembly 139 includes a pipe 148 extending through opening 133 with elbows 149 and 150 attached to each end, elbow member 149 being provided with a coupling 151 to which a water supply hose is connected (as indicated at 152), elbow member 150 being provided with a spray nozzle 153 to distribute water throughout tank 130.

Figure 10:
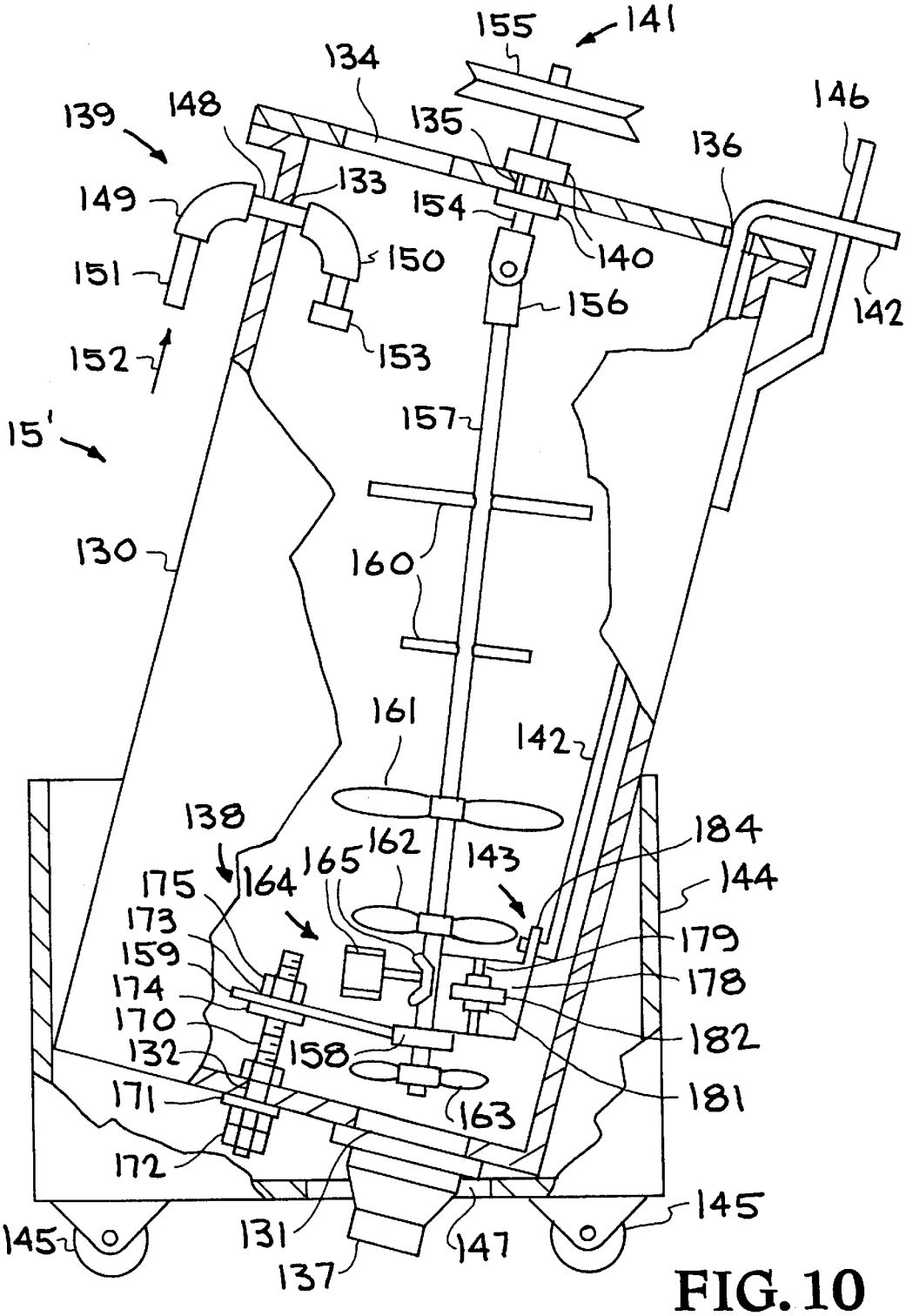
FIG. 10 is a view of an embodiment of a mixing tank adapted to supply mud to the pump of FIGS. 1A–1B, made in accordance with the present invention.
Figure 11:
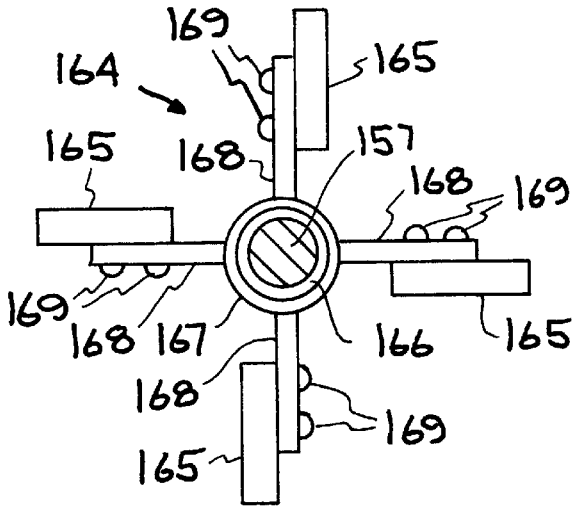
FIG. 11 is a top view of the ambulator paddles of FIG. 10.

Drive assembly 141 includes a first drive shaft or rod 154 mounted in bearings 140 having a drive sheave or pulley 155 mounted on the outer end and a U-joint 156 mounted on the inner end. Drive sheave 155 is driven by a belt and electric motor (not shown) which can be mounted to tank 130 or to cart 144, and may be powered as described above relative to mud pump 10. A second or main drive shaft or rod 157 is mounted at one end in U-joint 156 and is supported at an opposite end in a drive rod bearing 158 mounted in a support member 159 (see FIGS. 14 and 15) which is pivotably connected at one end to pivot support member 138. Mounted to the main drive rod 157 is a pair of traversely mounted stir rods 160, which may be of the same or different lengths, a large impeller 161, small impellers 162 and 163, with impeller 163 mounted at the end of drive rod 157, and an ambulator paddle assembly generally indicated at 164 (see FIGS. 11 and 15) having four (4) paddles 165. As seen in FIG. 11, the ambulator paddle assembly 164 includes an inner collar 166 mounted to drive rod 157 and an outer collar or member 167 having radially protruding members 168 to which paddles 165 are secured via bolts or screws 169. Note that paddles 165 may be of a non-flat configuration as seen in FIG. 10.

Figure 12:
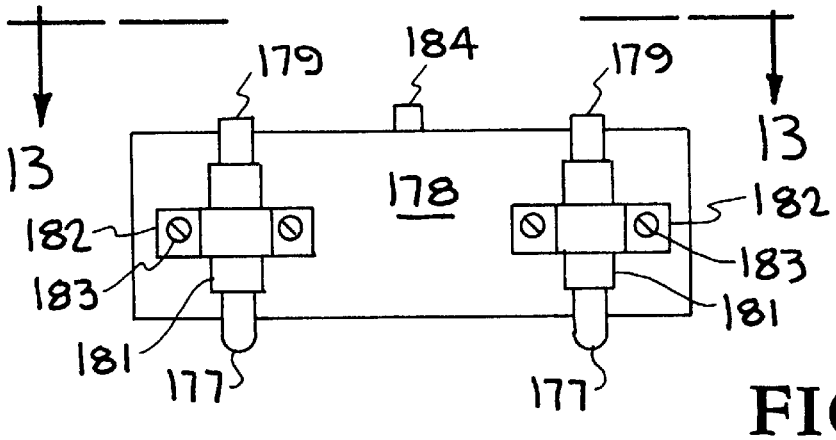
FIGS. 12 and 13 are outer side and top views, respectively, of the cowl of the mix/feed control and support rods for the cowl of FIG. 10.
Figure 13:
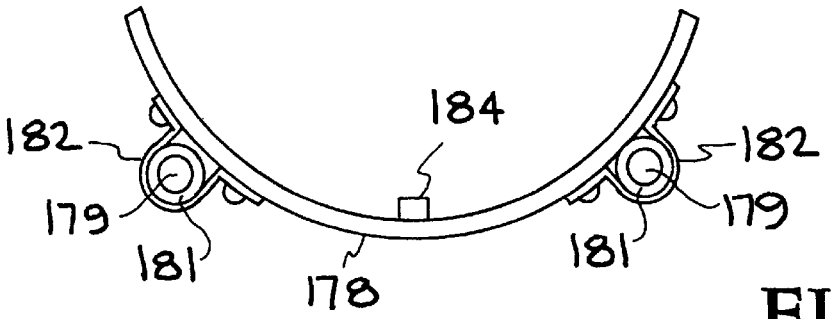
Figure 14:
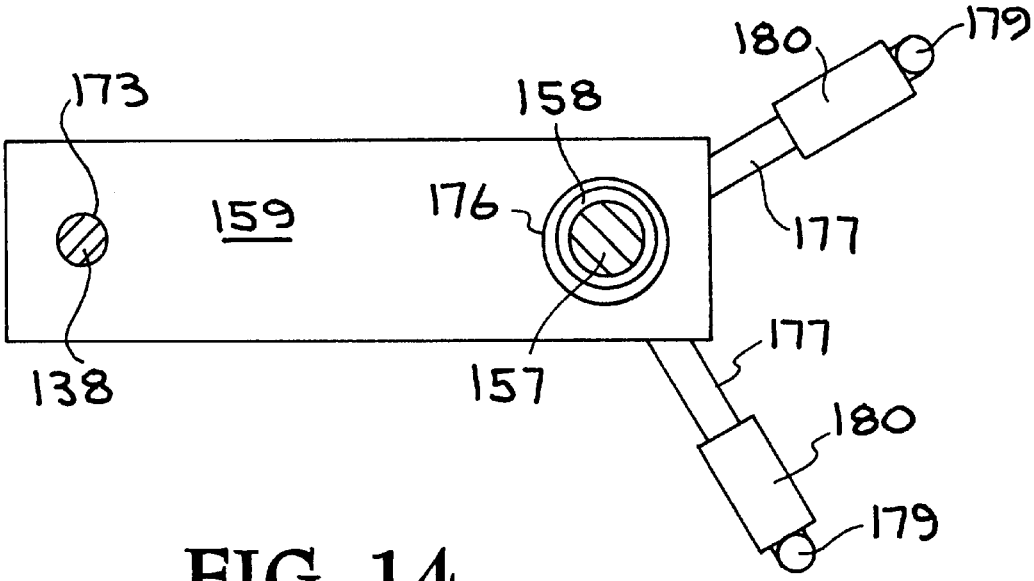
FIG. 14 is a view of the support bracket and support rods for the ambulator paddles and cowl of FIGS. 10 and 12.
Figure 15:
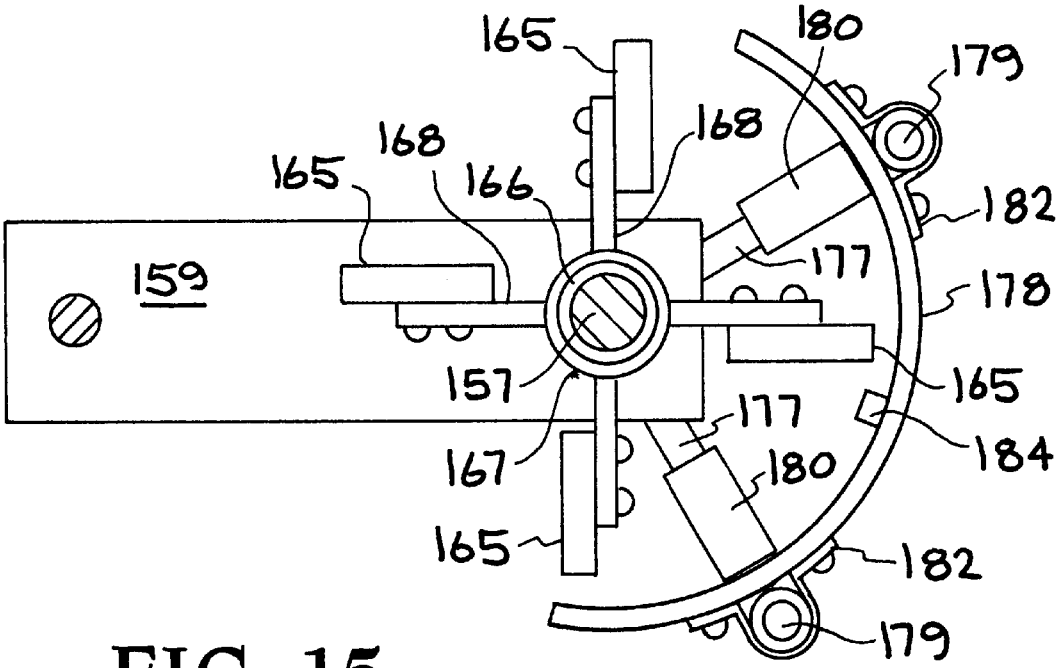
FIG. 15 illustrates the support bracket of FIG. 14 with the ambulator paddles and cowl of FIGS. 11–13 mounted thereon.

Support member 159 for main rod 157 is pivotably mounted via assembly 138 which includes a member or bolt 170 threaded at opposite ends and mounted in opening 132 of tank 130 via a washer 171 and lock nuts 172, with threaded member 170 extending through an opening 173 in support member 159 (see FIG. 14) and secured therein by a washer 174 and nut 175. As seen in FIG. 14, support member 159 also includes an opening 176 in which drive rod bearing 158 is mounted for supporting drive rod 157 and has a pair of outwardly extending support rods 177 attached thereto and which are mounted to and support a cowl 178 of mix/feed control 143 (as seen in FIGS. 12, 13 and 15). Support rods 177 have 90 degree curved ends 179 which extend under and up the outer side of cowl 178 and which are mounted in support rod bushings 181 mounted to cowl 178 via bushing retainers 182 and screws 183 (see FIGS. 10, 12 and 15). Support rods 177 are provided with spring clips 180. Connected to cowl 178 is a feed stop 184. The cowl 178 is initially manually raised to expose the paddle assembly 164 and moved manually down to cause the paddle assembly to move about the interior of the tank and mix the mud mixture to a thicker consistency. The spring clips 180 hold the cowl 178 in place. The mix/feed control handle 142 lays against the inside of tank 130 while in the mixing mode and is then turned 90 degrees to block the feed stop 182 during the feed mode.

In operation, a quantity of water via nozzle 153 is directed into tank 130 and a mud or grout mixture, such as described above, is deposited in the tank 130 via opening 134, and which is mixed therewith via stir rods 160 and impellers 161, 162 and 163. Stir rods 160 prevent clumping of the mud mixture. With the cowl 178 in the "down" position (as shown in FIG. 10), the ambulator paddles 165 provide forward motion to the main drive rod 157 (since only the uncowled paddles cause any residual force on the shaft) moving it around the circumference of the tank 130 via the U-joint 156, mixing the contents in the tank. The cowl 178 is placed in the "up" position at first in order that the water will swirl around the tank and mix with the mud mixture prior to the ambulator paddles being engaged.

It has thus been shown that the present invention provides an apparatus comprising a portable mud pump and mixing tank utilized for raising concrete members such as curb and gutter sections and flat sections including sidewalks, driveways, patios, etc. A principle component of the apparatus involved is the small portable mud or grout pump that delivers sufficient pressure and flow rate of mud to effectively carry out the raising of concrete members. The mud pump and mixing tank can be readily carried in a corner of a pickup truck bed and are easily cleaned and maintained, with the electricity supplied by 110V ac rectified to 12V dc, and the air for driving the mud pump being supplied by a small air compressor.

While specific embodiments, materials, parameters, etc. have been illustrated and/or described to exemplify and teach the principles of the invention, such are not intended to be limiting. Modifications and changes may become apparent to those skilled in the art, and it is intended that the invention be limited only by the scope of the appended claims.

What is claimed is:

1. An apparatus for supplying material under a raised curb and gutter comprising a portable mud pump and a material mixing tank, said portable pump comprising:

an air cylinder, a pump body, the air cylinder and pump body being interconnected end-to-end, a dual piston assembly having a first piston reciprocally mounted in the air cylinder and a second piston reciprocally mounted in the pump body, an air supply, A reversing valve assembly for controlling said air supply to opposite ends of the air cylinder for producing an intake stroke and a pumping stroke of the dual piston assembly, said reversing valve assembly including a reversible electric motor, a one way check valve located intermediate the pump body and said material mixing tank, and said pump body having a discharge section through which material from said mixing tank is pumped into a cavity under a raised curb and gutter section.

2. The apparatus of claim 1, wherein said dual piston assembly includes piston movement limiting actuators located in opposite ends of said air cylinder.

3. An apparatus for pumping material, comprising:

a portable pump having:

a pump body section, an air cylinder section, said pump body section and said air cylinder section being interconnected end-to-end, a reversing valve assembly including a reversible electric motor connected to said air cylinder section, and an air supply connected to said valve assembly; and a mixing tank, said mixing tank being connected to said pump body section of said portable pump via a one-way check valve, a discharge section connected to said pump body section, said pump section and said air cylinder having interconnected piston heads therein, whereby actuation of said reversing valve assembly causes movement of said piston heads in one direction, which produces an intake stroke and movement of said piston heads in an opposite direction, which produces a pumping stroke.

4. The portable pump of claim 3, additionally including piston head movement limiting actuators located in opposite ends of said air cylinder.

5. An apparatus for pumping material from a supply point to a point of use, comprising:

a portable pump having:

a pump body section and an air cylinder section interconnected end-to-end, a dual piston assembly having a first piston reciprocally mounted in the air cylinder section and a second piston reciprocally mounted in the pump body section, an air supply, a reversing valve assembly including a reversible electric motor for controlling said air supply to opposite ends of said air cylinder section for producing an intake stroke and a pumping stroke of the dual piston assembly, a one way check valve located intermediate said pump body section and said supply point, and said pump body section having a discharge section through which material from said supply point is pumped to said point of use.

6. The apparatus of claim 5, wherein said reversible valve assembly comprises:

a housing having a single inlet port connected to said air supply and a pair of outlet ports connected to said opposite ends of said air cylinder section, an assembly having a pair of spaced members movably mounted in housing, and a pair of control mechanisms operatively connected to opposite ends of said assembly and operatively connected to said reversible electric motor.

7. The apparatus of claim 5, wherein said first piston of said dual piston assembly is of a larger diameter than said second piston.

8. The apparatus of claim 5, wherein said dual piston assembly includes piston movement limiting actuators located in said opposite ends of said air cylinder section.

* * * * *